US006868709B2

(12) United States Patent
Adams et al.

(10) Patent No.: US 6,868,709 B2
(45) Date of Patent: Mar. 22, 2005

(54) APPARATUS AND METHOD FOR THERMOMECHANICALLY FORMING AN ALUMINIDE PART OF A WORKPIECE

(75) Inventors: John M. Adams, Mechanicsville, VA (US); Naohisa Tsukamura, Sumoto (JP)

(73) Assignee: Philip Morris USA Inc., Richmond, VA (US)

( * ) Notice: Subject to any disclaimer, the term of this patent is extended or adjusted under 35 U.S.C. 154(b) by 250 days.

(21) Appl. No.: 10/167,486

(22) Filed: Jun. 13, 2002

(65) Prior Publication Data

US 2003/0230366 A1 Dec. 18, 2003

(51) Int. Cl.[7] ..... B21D 37/16

(52) U.S. Cl. ..... 72/342.92; 72/342.5; 72/342.96; 72/402

(58) Field of Search ..... 72/342.1, 342.2, 72/342.5, 342.7, 342.8, 342.92, 342.96, 353.6, 354.2, 354.6, 358, 359, 370.01, 402; 219/61.1, 61.11, 61.4, 61.7

(56) References Cited

U.S. PATENT DOCUMENTS

| | | | | |
|---|---|---|---|---|
| 3,487,196 A | * | 12/1969 | Bachmann | 219/151 |
| 3,668,917 A | * | 6/1972 | Komatsu et al. | 72/342.3 |
| 3,728,887 A | * | 4/1973 | Bachmann | 72/318 |
| 3,793,873 A | * | 2/1974 | Iwata et al. | 72/318 |
| 3,827,275 A | * | 8/1974 | Suttan et al. | 72/342.1 |
| 4,263,799 A | * | 4/1981 | Motizuki | 72/318 |
| 5,388,594 A | | 2/1995 | Counts et al. | |
| 5,498,855 A | | 3/1996 | Deevi et al. | |
| 5,515,705 A | * | 5/1996 | Weldon et al. | 72/19.1 |
| 5,530,225 A | | 6/1996 | Hajaligol et al. | |
| 5,573,692 A | | 11/1996 | Das et al. | |
| 5,591,368 A | | 1/1997 | Fleischhauer et al. | |
| 5,613,505 A | | 3/1997 | Campbell et al. | |
| 5,620,651 A | | 4/1997 | Sikka et al. | |
| 5,665,262 A | | 9/1997 | Hajaligol et al. | |
| 5,708,258 A | | 1/1998 | Counts et al. | |
| 5,744,773 A | * | 4/1998 | Van Otteren et al. | 219/50 |
| 5,750,964 A | | 5/1998 | Counts et al. | |
| 5,954,979 A | | 9/1999 | Counts et al. | |
| 6,040,560 A | | 3/2000 | Fleischhauer et al. | |
| 6,280,682 B1 | | 8/2001 | Sikka et al. | |
| 6,284,191 B1 | | 9/2001 | Deevi et al. | |
| 6,463,779 B1 | * | 10/2002 | Terziakin | 72/342.96 |

OTHER PUBLICATIONS

Notification of Transmittal of the International Search Report or the Declaration for PCT/US03/15438 dated Nov. 2, 2004.

ASM International Handbook Committee, Forming Process for Sheet, Strip, and Plate, Forming and Forging, Metals Handbook Ninth Edition, 1988, pp. 554, ASM International, United States.

J.H. Schneibel, Strengthening of Iron Aluminides by Vacancies and/or Nickel, Metals Science & Engineering A258, 1998, ppgs.181–186, US Department Of Energy.

* cited by examiner

*Primary Examiner*—Ed Tolan
(74) *Attorney, Agent, or Firm*—Burns, Doane, Swecker & Mathis, L.L.P.

(57) ABSTRACT

A method of thermomechanically forming an aluminide part of a workpiece resistively heats at least a portion of the aluminide part, plastically deforms the heated portion of the aluminide part to a predetermined shape by applying pressure to the aluminide part positioned in a shaping member, and cools the aluminide part while applying pressure to maintain the aluminide part in the predetermined shape. The shaping member is movably mounted on a support base and a source of electricity provides an electrical current passing through the aluminide part for resistive heating of the part. The aluminide part can be a heater blade array for an electrically heated cigarette smoking system.

24 Claims, 3 Drawing Sheets

APPARATUS AND METHOD FOR THERMOMECHANICALLY FORMING AN ALUMINIDE PART OF A WORKPIECE

BACKGROUND

1. Field of the Invention

The invention is directed to a method of manufacture of metallic products such as aluminide metal sheets and an apparatus for performing the method. More particularly, the invention is directed to a hot forming operation that forms the metallic product geometry and tempers the product in a unitary step.

2. Background of the Invention

In the description of the background of the present invention that follows, reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

In a resistive heating assembly, such as a resistive heating assembly as disclosed in commonly assigned U.S. Pat. Nos. 5,530,225, 5,591,368, 5,665,262, and 5,750,964 for an electrical heater cigarette smoking system (EHCSS), a heater having a plurality of heater blade arrays can be resistively heated by passing a current therethrough. FIG. 1 shows a representative metallic part 100 of a resistive heating assembly. Heater blades 102 extending from and attached to a supporting hub 104 can be either single legs or multiple legs (i.e., two legs). The heater blades 102 are arranged to form an open cylindrical shaped heater fixture to accommodate a cigarette inserted therein. The heater blades 102 are preferably curved at intermediate portions 106 thereof such that a cigarette is contacted by the intermediate portions, i.e., the heater blade assembly is hour-glass shaped such that insertion of a cigarette into an open end 108 causes the heater blades 102 to expand outwardly when the cigarette is pushed through the intermediate portions 106 towards the hub 104.

Heater blades and heater blade arrays of an iron aluminide alloy have previously been made by cold forming a sheet and cutting the sheet into a heater array blank. The heater array blank comprised heater blades attached at the hub and had a carrier strip maintained on an opposite end of the sheet to facilitate handling. Subsequently, the heater array blank was formed into a substantially cylindrical shape, welded in a bonding apparatus, and formed to a final desired shape. The formed and bonded heater array was then tempered in an independent discrete step from the forming operation by contact with a heat sink (i.e., insertion of a straight ceramic rod) into the center portion of the cylindrical heater array and increasing the temperature of the heater array blades by the passing of an electrical current therethrough. The electrical current heated the array above a certain temperature and the heat sink quenched the array.

Several difficulties have been encountered with this production method. For example, the cold forming and cutting of the heater array blank resulted in a deformed final shape (e.g., misaligned heater blades and protruding heater blade legs). During the bonding or welding step, the individual heater blades misaligned causing the final tolerance of the heater array blank to be greater than acceptable. Misalignment resulted in a non-centered circular heater array assembly, and, after removal of the carrier strip, the final heater array shape was not maintained. Therefore, overall yield on the product was reduced, in some instances as much as 50% reduced. Moreover, the quenching operation of the heater array blank was performed in a separate processing step, complicating and adding expense to the manufacturing process.

Therefore, there is a need for a method of processing a metallic part in which the final tolerances are within an acceptable value, and resulting in a higher yield of the products produced. Further, it is desirable to minimize the number of operations in the assembly process by combining the thermomechanical operations into a minimum number of steps.

SUMMARY OF THE INVENTION

A method of thermomechanically forming an aluminide part of a workpiece comprises the steps of resistively heating at least a portion of the aluminide part, plastically deforming the heated portion of the aluminide part to a predetermined shape by applying pressure to the aluminide part positioned in a shaping member, and cooling the aluminide part while applying pressure to maintain the aluminide part in the predetermined shape.

The method can further comprise mounting the workpiece in a holding element having a surface conforming to a mating surface of the workpiece. The holding element can comprise at least one connector which contacts the aluminide part to form an electrical circuit therewith and thereby provide energy for the resistively heating step.

The method can still further comprise inserting an insert having a configuration with a non-uniform diameter or cross-section into an interior of the aluminide part. Accordingly, the plastically deforming step is carried out by pressing opposed portions of the shaping member toward each other so as to conform the aluminide part to the configuration of the insert, and optionally restraining a distal end of at least a portion of the aluminide part within a capture ring of the insert.

In one aspect, the aluminide part is an aluminide sheet formed into a substantially cylindrical geometry having an inner diameter, an outer diameter, and a plurality of heater blades extending from a hub, the geometry defining a heater blade array. In a further aspect, the aluminide part is thermomechanically formed from a binary iron aluminide or an iron aluminide alloy sheet.

An apparatus to thermomechanically form an aluminide part of a workpiece comprises a shaping member movably mounted on a support base and a source of electricity adapted to provide an electrical current to the aluminide part.

A first and second sliding portion of the shaping member can meet to form a cavity therebetween and at least one shaping element disposed on a surface of one of the first and second portions extends into the cavity and is adapted to contact an exterior surface of the aluminide part.

The apparatus can further comprise a holding element having a surface conforming to a mating surface of the workpiece and at least one connector which contacts the aluminide part to form an electrical circuit therewith. The apparatus can still further comprise an insert having a configuration with a non-uniform diameter or cross-section and adapted to cooperate with the shaping member to plastically deform the aluminide part to the predetermined shape.

BRIEF DESCRIPTION OF THE DRAWING FIGURES

Various features and advantages of the invention will become apparent from the following detailed description of preferred embodiments in connection with the accompanying drawings in which like numerals designate like elements and in which.

DETAILED DESCRIPTION OF THE PREFERRED EMBODIMENTS

The invention provides an apparatus for thermomechanically forming an aluminide part of a workpiece. The apparatus is useful for shaping a previously shaped aluminide sheet in a hot forming operation that plastically deforms the metallic product to a final geometry and heat treats the product in a unitary step.

Figure 2:
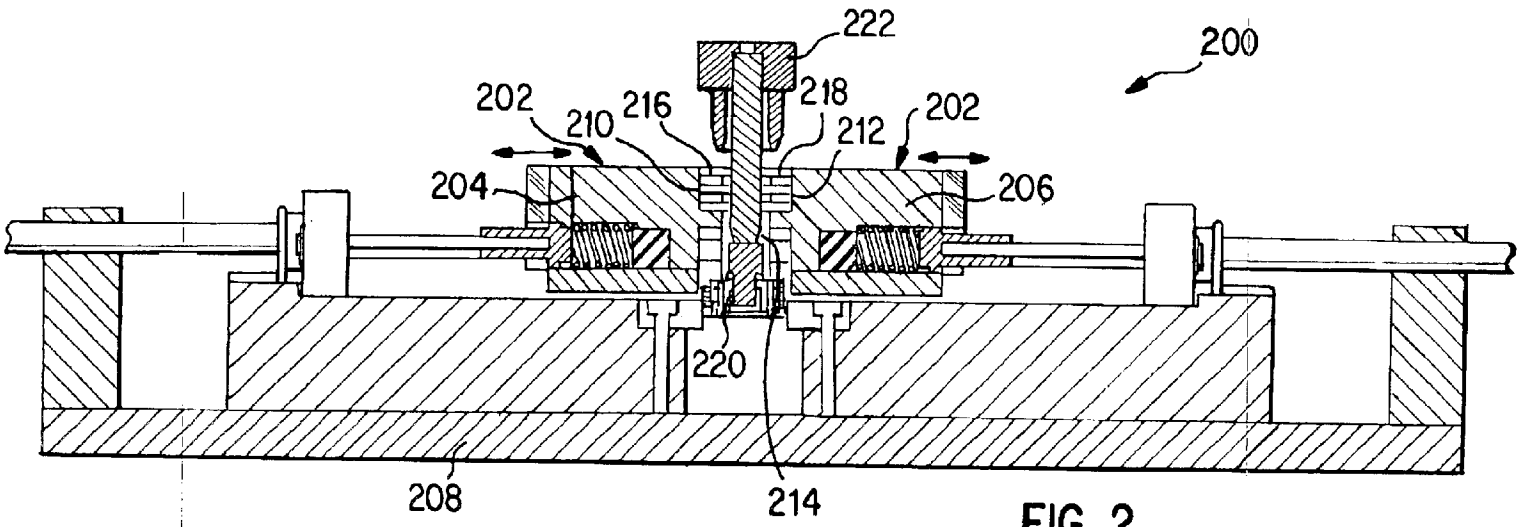
FIG. 2 is a schematic cross-section of an apparatus to thermomechanically form an aluminide part of a workpiece.

FIG. 2 shows an embodiment of an apparatus for thermomechanically forming an aluminide part of a workpiece 200. A shaping member 202 having opposing first and second portions 204, 206 is slidably disposed on a base 208 to contact the opposing faces 210, 212 and to form a cavity 214 therebetween. At least proximate the cavity 214, each opposing face 210, 212 has a plurality of shaping elements 216, 218 lining at least a portion of each of the respective opposing faces and proximate the cavity 214. A holding element 220 is disposed at the base of the cavity 214 and can be attached to the base 208 of the apparatus 200 by any suitable means, such as by a bolted connection. The holding element 220 orients and supports an aluminide part of a workpiece or an assembled workpiece (e.g., an aluminide sheet, a portion thereof, or a heater fixture) within the apparatus 200 and provides a connection to an electrical circuit to be formed with the mounted workpiece and a power source (not shown). The electrical circuit resistively heats at least a portion of the aluminide part. An insert 222 such as a rod-like member is configured to be inserted into the interior of the heated portion of the aluminide part and extends to and vertically aligns with the holding element 220.

Figure 3:
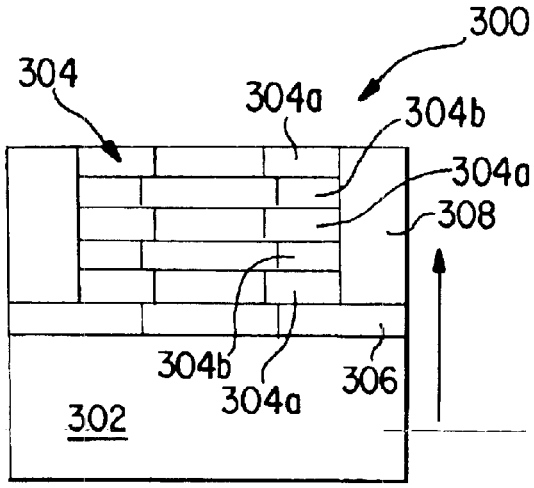
FIG. 3 is a side elevation of a portion of the shaping member showing the opposing face and the shaping elements.

FIG. 3 shows a side elevation of a first opposing portion 300 of the shaping member showing an exemplary embodiment of the opposing face 302 and the plurality of shaping elements 304 disposed thereon. The shaping elements 304 can be of at least two different dimensions 304*a* and 304*b* and are stackable and changeably mounted to the respective opposing face 302 above a horizontally extending flange 306. The variation in the dimensions of the shaping elements 304 is such that a portion of the surface of at least one of the shaping elements 304 on each opposing face contacts with the outer surface of the aluminide part at selected positions to at least substantially conform the outer surface of the workpiece to desired dimensions (e.g., to at least substantially conform the inner surface of the aluminide part to the dimensions of the insert during operation of the apparatus). The desired shape can be attained when the aluminide part is heated and pressure applied by opposing portions of the shaping member pressing toward each other. For example, in one aspect, shaping elements of a longer width 304*a* are in contact with the aluminide part positioned within the cavity and shaping elements of a shorter width 304*b* are not in contact with the aluminide part.

The shorter width shaping elements 304*b* can position the longer width shaping elements 304*a* along the opposing faces 302 in the vertical direction 308. In one aspect, none, one, or more than one shorter width shaping element can be vertically interspersed with the longer width shaping elements in a stacking arrangement and to provide a desired surface configuration of the opposing face of each portion of the shaping member. For example, the FIG. 3 embodiment alternates longer width shaping elements with shorter width shaping elements vertically along the opposing face. The shorter and longer width shaping elements can be attached by, for example, a retaining pin passing through each shaping element and secured to the extending flange or by other suitable means.

Figure 4:
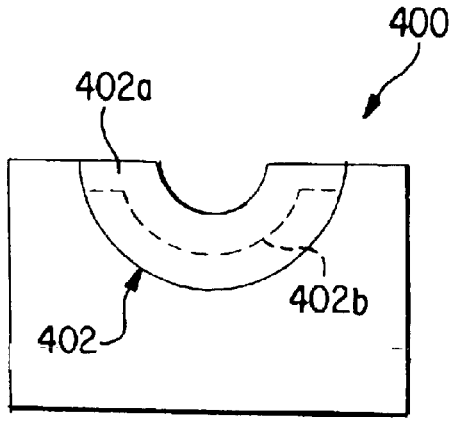
FIG. 4 is a top plan view of the portion of the shaping member of FIG. 3.

FIG. 4 shows a top plan view of the first opposing portion 400 of the shaping members showing the shaping elements 402. The longer width shaping elements 402*a* project further into the cavity 404 than the shorter width shaping elements 402*b*. Thus, upon operation the longer width shaping elements 402*a* contact the surface of the aluminide part and plastically deform the aluminide part to a final geometry while the shorter width shaping elements 420*b* do not contact the aluminide part.

In one aspect and as depicted in FIGS. 2–4, the shaping elements are semi-annular rings. However, it should be appreciated that any geometry can be selected that conforms to the desired final geometry of the aluminide part of the workpiece. For example, shaping elements in the form of conics, regular and irregular polygons, portions of plane curves such as cycloids and trochoids, and/or complex geometric forms can be used.

In another aspect and as depicted in FIGS. 2–4, five shaping elements are positioned on the opposing faces of the first and second portions of the shaping members. Further, each shaping element is shown as a semi-annular ring having one of two different radii and that adjacent shaping elements have different radii. However, it should be appreciated that any number of shaping elements and that any sequence of the shaping elements can be used. For example, one, two, three, or more shaping elements can be positioned along the length of the aluminide part of the workpiece corresponding to positions to be thermomechanically formed. Similarly, multiple adjacent shaping elements can have similar or dissimilar dimensions, such as a radius, a chamfered edge, a protrusion and so forth. Also, the shaping element can be a single shaping element lining the opposing faces or a portion of the opposing faces. The single shaping element can have a surface with multiple geometries for thermomechanical forming of the workpiece. Further, combinations of the above described shaping elements can be used.

The opposing face of the second portion of the shaping member can be substantially the same as that of the first portion in the case of, for example, an axially symmetric aluminide part, or the opposing face of the second portion can have a different configuration to accommodate positional variations in the aluminide part.

The shaping elements can be made of any suitable material that can plastically deform the workpiece under pressure at an elevated temperature (i.e., suitable for a thermomechanical application). In one aspect, the aluminide part can be heated to an elevated temperature by establishing an electrical circuit that runs through the aluminide part from the holding element and the electrical source and applying an electrical current to thereby resistively heat the aluminide part. The shaping elements can be electrically insulating to prevent short circuiting between the aluminide part and the shaping member during resistive heating. For example, the shaping elements can be a non-electrically conductive ceramic material or a ceramic with polyether ether keytone. A suitable ceramic material is an engineering ceramic such as Type No. A9951 (Alumina 99.5%) available from Nihon Ceratech Co., Ltd., Japan. In another example, the shaping elements can be of dissimilar materials. Shaping elements in contact with the workpiece, e.g., longer width shaping element 304*a* in the exemplary embodiment shown in FIG. 3, can be electrically insulating to prevent short circuiting, such as shaping elements of non-electrically conductive ceramic material or a ceramic with polyether ether keytone. Shaping elements not in contact with the workpiece, e.g., shorter width shaping element 304*b* in the exemplary embodiment shown in FIG. 3, can be of any suitable material. For example, shaping elements not in contact with the workpiece can be a metallic material, which can aid in the cooling of the workpiece by providing a thermal mass in the shaping element that can serve as a heat sink.

Figure 5:
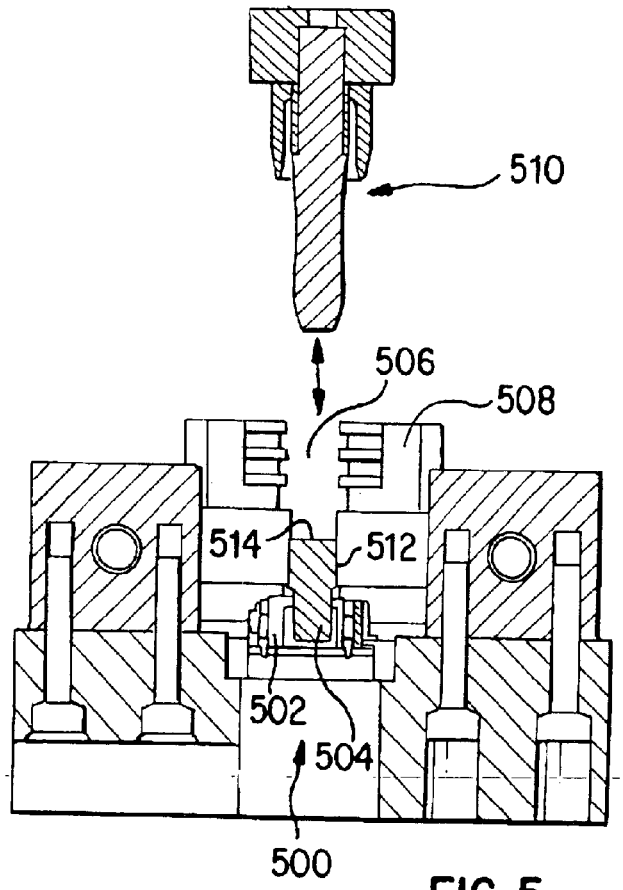
FIG. 5 is a schematic cross-section of an embodiment of a holding element.

FIG. 5 shows a schematic cross-section of an embodiment of a holding element 500 depicted in the environment of the apparatus. The holding element 500 comprises a socket 502 conforming to a mating surface of the aluminide part and/or the workpiece. The socket 502 is radially disposed about a tempering base 504 that extends therefrom into the cavity 506 formed by the shaping member 508. The tempering base 504 substantially aligns vertically with an insert 510 and is preferably similarly configured on an outer surface 512 to substantially conform with the inner diameter of the corresponding length of the aluminide part and/or the workpiece. The aluminide part and/or the workpiece is supported in the apparatus by mounting a mating surface the aluminide part and/or workpiece with the socket 502. Optionally, the mounted aluminide part and/or workpiece can have a friction fit with the tempering base 504 and thereby be further supported when mounted. After mounting the aluminide part and/or the workpiece, the insert 510 can be slidably positioned in the interior of the aluminide part and/or the workpiece to abut the tempering base 504 at a proximal end 514.

The socket 502 receives the aluminide part and/or the workpiece and is electrically configured to form a complete electrical circuit with the aluminide part and/or the workpiece and an external power source. For example, the aluminide part can comprise heater blades attached to a non-metallic base to form an assembled heater fixture. In this case, the assembled heater fixture is inserted into the holding element so as to complete an electrical circuit (e.g., the assembled heater fixture is a male connection with at least one protruding connector and the holding element is a female connection adapted to receive the protruding connector). In another example, the aluminide part can be directly positioned within the holding element in a manner which provides a friction fit between a positive lead and a negative lead to respective portions of the aluminide part to form an electrical circuit.

The tempering base is electrically insulating to prevent short circuiting between the aluminide part and/or the workpiece and the apparatus during resistive heating. For example, the tempering base can be of a non-electrically conductive ceramic material or a ceramic with polyether ether keytone. A suitable ceramic material is an engineering ceramic such as Type No. A9951 (Alumina 99.5%) available from Nihon Ceratech Co., Ltd., Japan. In a further example, the tempering base and the shaping elements are manufactured of the same material.

Figure 6:
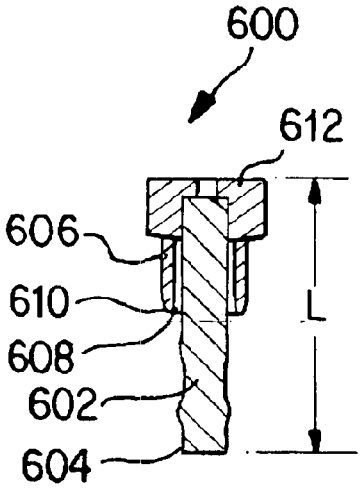
FIG. 6 is a first embodiment of an insert.

FIG. 6 shows a first embodiment of an insert 600 having a rod-like shape. The insert 600 has an elongated section 602 having an outer surface 604 and a configuration with a non-uniform diameter or cross-section along its length L. The outer surface 604 can be substantially conforming to the inner configuration of the finished aluminide part and/or workpiece (i.e., the dimensions after heating, plastically deforming and cooling) and the insert 600 can be slidably positioned within the aluminide part and/or workpiece positioned in the holding element and within the cavity formed by the first and second portions of the shaping member.

The insert 600 can have an optional capture ring 606 located at one end thereof. The capture ring 606 can be a sleeve positioned radially outward of the elongated section 602 with an opening 608 offset from the outer surface 604 and facing the proximal end to receive a portion of the aluminide part (e.g., an edge of the metallic workpiece that extends beyond the shaping member). The portion 610 of the capture ring about the opening 608 can be configured to facilitate the insertion and removal of a portion of the aluminide part (i.e., the opening can be defined by a chamfered edge or other expedient).

The insert 600 can also optionally have a heat sink 612 at a distal end that is in thermal communication with the insert. The heat sink 612 can be in the form of a convective or radiative heat sink (i.e., cooling fins) or can be of a forced cooling variety (i.e., the heat sink can include passages for a circulating medium such as water, air, inert gas, oil, and so forth, the details of which are not shown). The insert can be electrically insulating to prevent short circuiting between portions of the aluminide part and/or with the apparatus during resistive heating. For example, the insert can be a non-electrically conductive ceramic material or a ceramic with polyether ether keytone. A suitable ceramic material is an engineering ceramic such as Type No. A9951 (Alumina 99.5%) available from Nihon Ceratech Co., Ltd., Japan. In a further example, the tempering base, the shaping elements and the insert are manufactured of the same material.

Figure 7:
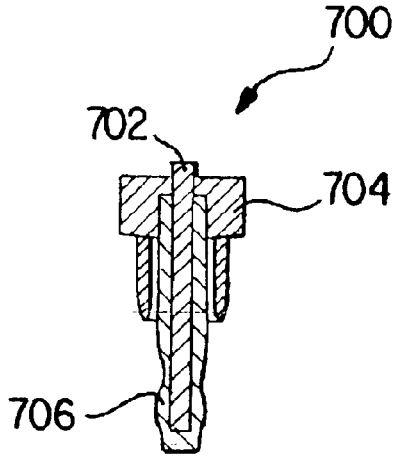
FIG. 7 is another embodiment of an insert.

In the alternative embodiment shown in FIG. 7, the insert 700 has a central metallic pin 702 in thermal contact with the distal end heat sink 704 to allow improved cooling. The outer surface 706 of the insert 700 can be a coating that is electrically insulating and thermally conducting. For example, the coating can be a non-electrically conductive ceramic material or a ceramic with polyether ether keytone. A suitable ceramic material is an engineering ceramic such as Type No. A9951 (Alumina 99.5%) available from Nihon Ceratech Co., Ltd., Japan.

Similar to the insert, the first and second portions of the shaping member can have a cooling feature such as those described for the insert (i.e., convective, radiative, or forced cooling).

Figure 8:
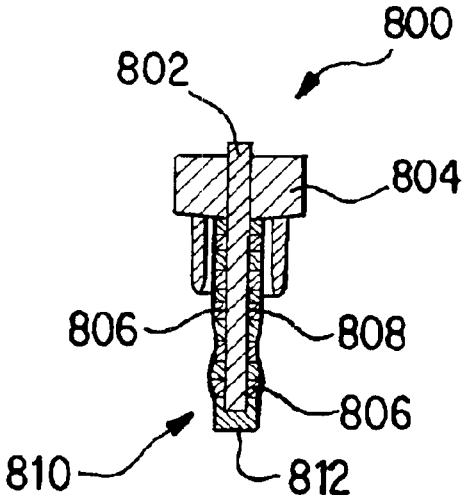
FIG. 8 is an additional embodiment of an insert.

In another embodiment of the insert shown in FIG. 8, the insert 800 has a central metallic pin 802 in thermal contact with the distal heat sink 804 to allow improved cooling. A plurality of stackable elements 804 can be arranged about the outer surface 808 of the insert 800, e.g., can be stacked onto the central metallic pin 802. The stackable elements 804 are secured to the insert 800 by suitable means, e.g., the proximal end 810 of the central pin 802 can be threaded and a terminating stackable element 812 can cooperate with the threads to secure the stackable elements 804 to the insert 800. The stackable elements are electrically insulating and thermally conducting. For example, the stackable elements can be a non-electrically conductive ceramic material or a ceramic with polyether ether keytone. A suitable ceramic material is an engineering ceramic such as Type No. A9951 (Alumina 99.5%) available from Nihon Ceratech Co., Ltd., Japan. is a, the insert can be formed. As shown in FIG. 8, the insert is formed from X stackable elements. However, it should be appreciated that the insert can be formed from any number of stackable elements. Further, the stackable elements can provide an outer surface to the insert of any form and that any sequence of the stackable elements can be used. For example, one, two, three, or more stackable elements can be positioned along the length of the central pin of the insert corresponding to positions on the workpiece to be thermomechanically formed. Similarly, multiple adjacent stackable elements can have similar or dissimilar dimensions, such as a radius, a chamfered edge, a protrusion and so forth.

In one aspect, the aluminide part can be a heater blade array of sheet metal, such as a binary iron aluminide or an iron aluminide alloy and the aluminide part receives a cigarette or cigarette-like member. For example, the heater blade array can be for a smoking appliance, such as those described in commonly assigned U.S. Pat. Nos. 5,530,225, 5,591,368, 5,665,262, and 5,750,964, the contents of which are herein incorporated by reference. Such a heater blade array can be formed from a sheet of binary iron aluminide or iron aluminide alloy by a cold forming operation followed by a bonding operation to form the cylindrical shaped heater fixture and then subject to a final thermomechanical operation. Suitable binary iron aluminide or iron aluminide based alloys include those disclosed in commonly assigned U.S. Pat. Nos. 5,620,651, 6,280,682 and 6,284,191, the contents of which are herein incorporated by reference.

In a preferred embodiment, the aluminide part can be a cold formed sheet formed into a desired geometry having an inner diameter, an outer diameter, and a plurality of heater blades extending from a hub and arranged in the form of a cylindrical cage so as to define a heater blade array. For example, a cylindrical heater blade array can be made from a sheet of iron aluminide alloy cut into a patterned array blank in a stamping operation wherein the sheet includes a base strip to facilitate handling. The stamped aluminide material can be formed substantially into the heater blade array by bending the sheet into a tubular shape and welding along an edge of the base strip to form a hub from which the heater blades extend. In one aspect, the heater array blank and subsequent heater blade array can include eight heater blade pairs, each blade pair comprising two legs and interdigitated in the longitudinal direction. The heater blade array can be substantially cylindrical with a central opening for receiving a cigarette. In one specific example, the blades are approximately 20 mm long and from 0.100 to 0.150 inches wide and the outer diameter of the tubular shaped heater blade array is about ⅜ of an inch.

Figure 1:
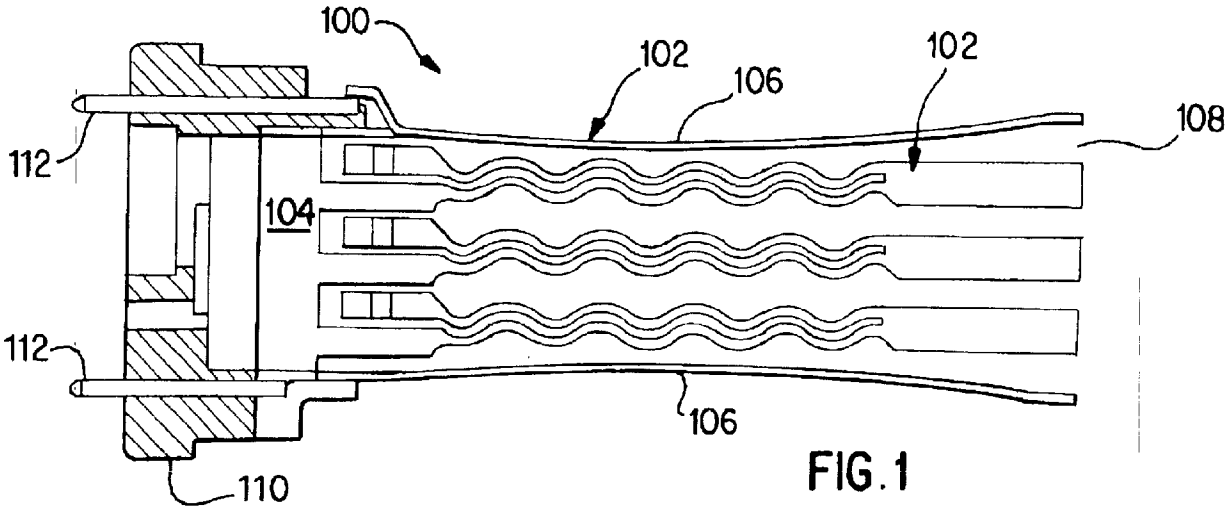
FIG. 1 shows a representative metallic part of a resistive heating assembly.

The heater blade array can be further assembled to a non-metallic base to form an assembled heater fixture. The non-metallic base can be a plastic or ceramic base which includes electrical connections to pass electrical current to the respective heater blades. For example and as shown in FIG. 1, the assembled heater unit with a non-metallic base 110 may have a plurality of connectors or pins 112 which cooperatively engage with a plurality of indents or pinholes which are electrically connected to a source of electricity. The established electrical circuit can then be utilized to resistively heat at least a portion of the heater blade array. In another example, the heater blade array can be assembled to a spacer and/or a heater fixture base to form the assembled heater fixture. Examples of spacers, heater fixture bases and heater fixtures are disclosed in commonly owned U.S. Pat. Nos. 5,750,964 and 6,040,560, the entire contents of which are herein incorporated by reference. The assembled heater fixture can include an electrical assembly which can interface with an exterior energy source or electrical circuit through the holding element of the apparatus. Examples of electrically wired heater blades and assembled heater fixtures are disclosed in commonly owned U.S. Pat. Nos. 5,530,225, 5,591,368, 5,665,262, and 5,750,964, the contents of which are herein incorporated by reference.

In the thermomechanical operation, the heater blade array or assembled heater fixture is mounted on a holding element about a tempering base such that the tempering base extends into the interior (i.e., the interior space of the heater blade array or assembled heater fixture) a distance substantially corresponding to the hub of the heater blade array and the hub end of the assembled heater fixture and any electrical connections thereon are in electrical communication with the electrical circuit associated with the holding element (e.g., the heater blade array can be mounted to contact a source of electricity or the assembled heater fixture can be inserted in a receptacle, such as a socket, on the base wherein electrical connections are provided for heating the heater blade array during the thermomechanical operation). The insert is inserted into the interior space of the heater blade array from the opposite end from the holding element such that the insert is in contact and vertical alignment with the tempering base. Additionally, the outer surface of the insert is in contact with the inner diameter of the heater blade array continuously along at least a portion of the length of the heater blade array. Optionally, a distal end of the heater blade (e.g., the end distal from the hub) can be inserted into a capture ring of the insert.

The shaping member preferably includes first and second shaping members (e.g., first and second portions of the shaping member) which are slidably positioned on either side of the workpiece, e.g., the heater blade array or assembled heater fixture is located in a cavity formed between the shaping members. The first and second shaping members can include a plurality of shaping elements disposed on the opposing faces proximate the cavity. When the first and second shaping members are slidably positioned about the heater blade array or the assembled heater fixture, opposed shaping elements contact the heater blade array at a position on the outer periphery of the heater blade array. The contact points can be point contacts or zone contacts, depending on the desired plastic deformation to be achieved in the thermomechanical process. Additionally, the position of each of the shaping elements can correspond to a position on the elongated section of the insert that has a desired shape in its surface (i.e., concave portion or other surface depression feature) such that the heater blade array can be plastically deformed to conform to the desired shape. For example, the combination of pressure from the shaping members and heat from the resistance heating of the blades can impart the desired shape to the heater blades (i.e., application of pressure by the shaping members can form an inward facing bow or other desired geometry).

In one embodiment, the apparatus has a first and second portion of the shaping member with three longer width shaping elements on each respective opposing face. Interspersed between each longer width shaping element is one shorter width shaping element. Accordingly, each longer width shaping element projects beyond the width of the shorter width shaping element and into the cavity formed by the opposing faces of the first and second portions of the shaping member.

In a further embodiment, in the manufacture of a heater blade array for a smoking appliance, the shaping elements are semi-annular and correspond to positions designed to accommodate the insertion of a cigarette into the heater fixture. Accordingly, the positions are such that they deform the heater blade array during the thermomechanical operation such that the final shape of the workpiece applies a pressure (e.g., a spring pressure) to the cigarette while the cigarette is located in the heater fixture (i.e., a bow, concave or tapered geometry). Examples of suitable final shapes of the heater blade array are disclosed in commonly owned U.S. Pat. Nos. 5,530,225, 5,591,368, 5,665,262, 5,750,964, and 6,040,560, the contents of which are herein incorporated by reference.

In one example of an apparatus for thermomechanically forming an aluminide part of a workpiece into a heater blade array for a smoking appliance, each shaping member portion has three longer width shaping elements to correspondingly deform the heater blade array at three positions along the length of the heater blade array. A first position of the heater blade array is substantially located at the receiving end (i.e., the end into which the cigarette is to be inserted) and has a nominal inner diameter of 0.134 inches. A second position is substantially at the maximum insertion location of the cigarette and has a nominal inner diameter of 0.129 inches. A third position is approximately halfway in between first and second positions and has a nominal inner diameter of 0.128 inches.

After mounting the aluminide part and/or the workpiece and the insert within the apparatus, pressure is applied to the outer diameter of the heater blade array and at least a portion of the heater blade array is heated to a predetermined temperature associated with the selected material. The temperature can be maintained continuously, can be maintained for a predetermined period of time, or cycled during the application of pressure.

In an embodiment in which the heater array is a binary iron aluminide (i.e., FeAl) or an iron aluminide alloy, heating can be resistive heating resulting from passing electrical energy through at least a portion of the aluminide part. In one example, an electrical circuit can be established between the hub and the distal end of the extending heater blades. In another example, the electrical circuit can be established in the heater blade array by the assembly of the heater blade array to a spacer and/or a heater fixture base to form an assembled heater fixture which includes an electrical assembly which can interface with an exterior energy source or electrical circuit. By passing electrical current through the established circuit, the heater blade array can be resistively heated. In such a case, the shaping elements are preferably made of an electrically non-conducting material to avoid electrical shorting of the current passing through the heater blades.

In one aspect, electrical energy is passed through at least a portion of the heater blade array by pulsing the electrical current. For example, the electrical current can be pulsed in at least two cycles, although any number of cycles can be applied, so as to raise and maintain the temperature to a desired value during the plastic deformation operation. As an example, for an iron aluminide part, during the first cycle, a portion of the heater blade array is heated to a temperature greater than 600° C. During the second cycle, the electrical energy is applied so as to maintain the temperature of the portion of the heater blade array at greater than 600° C. For iron aluminide, the individual cycles are approximately one to two seconds in duration and the desired temperature can be reached by applying approximately 8 amps to the heater array. However, the electrical energy can be pulsed at any frequency and amperage sufficient to achieve the desired temperature while also preventing degradation of any non-metallic base associated with the workpiece (e.g., melting of a plastic base of an assembled heater fixture). Additionally, pulsing can facilitate the maintenance of the desired temperature during the second and subsequent cycles. Further, in the exemplary heater blade array having any number of blades or blade pairs, the blades or blade pairs may be heated simultaneously, or in a predetermined sequence (e.g., sequentially, consecutively, in a torque pattern, and so forth). Between applications of the electrical energy, the insert can cool the heater blade array.

The electrical energy can be controlled to provide electrical energy for resistive heating to the maximum number of blades for the shortest practical time to increase throughput of the apparatus in a manufacturing environment. For example, for an eight bladed heater array formed of iron aluminide, the electrical energy can be applied continuously, as a pulse, or in a predetermined sequence such as a star torque pattern, sequentially or in pairs. In one aspect, the electrical energy power supply is similar to that used in an EHCSS and the electrical energy is supplied in a star torque pattern. In an additional aspect, the electrical energy power supply is a plurality of individual power supplies providing up to 20 amps to each of the blades of the heater array and the electrical energy is supplied sequentially or simultaneously to the heater array.

As electrical energy is provided to more blades of the heater array in a shorter period of time, the manufacturing process can proceed more quickly. However, the electrical circuit between the apparatus and the workpiece, i.e., the socket, needs sufficient electrical capacity to accommodate the increased electrical load without resulting in IR losses in the circuit that can deleteriously impact non-conducting components by, for example, breaking down dielectric insulators or melting components. For example, in an eight bladed heater array, the socket has eight leads each corresponding to one blade and two common leads to complete the electrical circuit. Thus, the two common pins carry approximately four times the load of the leads corresponding to the blades, with an associated increase in amperage and heat generation.

Although the electrical energy can be passed through the entire heater blade array, it is preferably to heat at least the portion of the heater blade array that corresponds to that portion of the heater blade array positioned between the first and second portions of the shaping member. Most preferably, the heated portion corresponds to at least the portion of the heater array being plastically deformed in the vicinity of the extended shaping elements and the portion of the length of the insert having a configuration with a non-uniform diameter or cross-section.

After heating and applying pressure to the heater blade array, the heating is terminated and the aluminide part and/or the workpiece is rapidly cooled through via heat transfer to the insert.

The pressure and temperature features of the method provide thermomechanical plastic deformation of the aluminide part of a workpiece. Additionally, the heating and quenching operations improve the hardness of the aluminide part. For example, a binary iron aluminide after cold forming to form a heater blade array has a Vickers hardness of approximately 380 Hv. After the thermomechanical operation, the heater blade array can be provided with a Vickers hardness of greater than 500 Hv. Further, by use of the described method, the heater blade array and/or the heater blade array assembled into the heater fixture can be provided with a desired shape having close tolerance, e.g., a tolerance of plus or minus ten thousandth of an inch with the tolerances being reproducibly achieved and the yield on the process being increased to greater than 95%.

Although the present invention has been described in connection with exemplary embodiments thereof, it will be appreciated by those skilled in the art that additions, deletions, modifications, and substitutions not specifically described may be made without departing from the spirit and scope of the invention as defined in the appended claims.

What is claimed is:

1. An apparatus for thermomechanically forming an aluminide part of a workpiece, the apparatus comprising:

a shaping member movably mounted on a support base; and a source of electricity adapted to provide an electrical current to the aluminide part; and a holding element having a socket conforming to a mating surface of the workpiece, wherein the holding element comprises at least one connector which contacts the aluminide part to form an electrical circuit therewith.

2. The apparatus of claim 1, wherein the apparatus is adapted for the workpiece to be inserted into contact with the holding element through a center portion of the shaping member.

3. The apparatus of claim 1, wherein the holding element is adapted to hold at least a portion of a wall of the workpiece, wherein the workpiece is hollow.

4. The apparatus of claim 1, wherein the shaping member comprises first and second sliding portions adapted to form a cavity therebetween and at least one shaping element disposed on a surface of the first and/or second portions so as to extend into the cavity and contact an exterior surface of the aluminide part.

5. The apparatus of claim 4, wherein at least the one shaping element contacts the exterior surface of the aluminide part at a point contact.

6. The apparatus of claim 4, wherein at least one shaping element comprises a plurality of shaping elements, each of the shaping elements being individually stackable and changeably mounted to the respective first and second portion above a horizontal extending flange of the shaping member.

7. The apparatus of claim 6, wherein each shaping element is electrically insulating and thermally conducting.

8. The apparatus of claim 6, wherein each shaping element comprises a non-conductive ceramic material.

9. The apparatus of claim 6, wherein the apparatus further comprises an insert located in the cavity, at least one of the shaping elements extends into the cavity at a position corresponding to a concave position on the insert.

10. The apparatus of claim 1, wherein the shaping member is radiatively, convectively, or forced cooled.

11. The apparatus of claim 1, further comprising:

an insert having a configuration with a non-uniform cross-section and adapted to cooperate with the shaping member to control the shape of the aluminide part when the electrical current is provided to the aluminide part.

12. The apparatus of claim 11, wherein the insert comprises a ceramic material.

13. The apparatus of claim 11, wherein the insert comprises a metallic pin and an electrically insulating and thermally conducting coating, wherein said metallic pin conducts heat from the workpiece to a heat sink.

14. The apparatus of claim 13, wherein the coating comprises a ceramic.

15. The apparatus of claim 11, wherein the insert comprises a heat sink disposed at a distal end and in thermal communication therewith.

16. The apparatus of claim 15, wherein the heat sink is radiatively, convectively, or forced cooled.

17. The apparatus of claim 1, further comprising an insert configured for insertion into a cavity within the workpiece, wherein the insert is configured to contact the holding element after insertion into the workpiece.

18. The apparatus of claim 17, wherein the shaping member is configured to apply a lateral force on the workpiece with the insert therein.

19. The apparatus of claim 17, wherein the insert, the workpiece and the at least one connector of the holding element are structurally configured such the workpiece with the insert therein is within the shaping member, and wherein the insert and the at least one connector of the holding element are adapted to allow the workpiece to contact the at least one connector of the holding element.

20. The apparatus of claim 1, further comprising an insert with a capture ring, wherein the capture ring has a sleeve positioned radially outward of an elongated section of the insert and with an opening offset from an outer surface of the insert to receive a portion of the aluminide part.

21. The apparatus of claim 17, wherein the insert is configured to be located within the periphery of the workpiece and the shaping member is configured to be located outside of the periphery of the workpiece.

22. The apparatus of claim 21, wherein the insert is configured to fit within the workpiece, and wherein the workpiece is a hollow cylindrical workpiece.

23. The apparatus of claim 1, wherein the aluminide part of the workpiece comprises a cylindrical heater blade array with bowed blades, further comprising an insert comprising elements surrounding an axial member, wherein the elements are positioned along the length of the axial member, and wherein an outer surface of the elements includes an annular recess conforming to a desired shape of the bowed blades of the cylindrical heater blade array.

24. An apparatus for thermomechanically forming an aluminide part of a workpiece, the apparatus comprising:

a shaping member movably mounted on a support base;

a source of electricity adapted to provide an electrical current to the aluminide part; and an insert having a configuration with a non-uniform cross-section and adapted to cooperate with the shaping member to control the shape of the aluminide part, wherein the insert comprises a capture ring disposed at a position toward a distal end thereof, the capture ring including a sleeve positioned radially outward of an elongated section of the insert and with an opening offset from an outer surface of the insert and facing a proximal end to receive a portion of the aluminide part.

* * * * *